US007382224B2

(12) United States Patent
Wang et al.

(10) Patent No.: US 7,382,224 B2
(45) Date of Patent: Jun. 3, 2008

(54) OVER-CURRENT PROTECTION DEVICE

(75) Inventors: Shau Chew Wang, Taipei (TW); Fu Hua Chu, Taipei (TW); Kuo Chang Lo, Taipei (TW)

(73) Assignee: Polytronics Technology Corp., Hsinchu (TW)

( * ) Notice: Subject to any disclaimer, the term of this patent is extended or adjusted under 35 U.S.C. 154(b) by 219 days.

(21) Appl. No.: 11/454,870

(22) Filed: Jun. 19, 2006

(65) Prior Publication Data

US 2007/0035378 A1 Feb. 15, 2007

(30) Foreign Application Priority Data

Aug. 11, 2005 (TW) ..... 94127286 A

(51) Int. Cl.
*H01C 7/10* (2006.01)

(52) U.S. Cl. ..... 338/22 R; 338/20; 219/548; 252/511

(58) Field of Classification Search ..... 338/20, 338/22 R, 328, 332; 219/548–549, 541; 252/511–513, 518–519
See application file for complete search history.

(56) References Cited

U.S. PATENT DOCUMENTS 4,955,267 A * 9/1990 Jacobs et al. ..... 29/611
5,140,297 A * 8/1992 Jacobs et al. ..... 338/22 R
5,227,946 A * 7/1993 Jacobs et al. ..... 361/106
5,856,773 A * 1/1999 Chandler et al. ..... 338/22 R
6,111,234 A * 8/2000 Batliwalla et al. ..... 219/549
6,593,844 B1 * 7/2003 Iwao et al. ..... 338/22 R

* cited by examiner

*Primary Examiner*—K. Richard Lee
(74) *Attorney, Agent, or Firm*—Volentine & Whitt, PLLC

(57) ABSTRACT

An over-current protection device comprises two metal foils and a positive temperature coefficient (PTC) material layer. The PTC material layer is sandwiched between the two metal foils and comprises plural crystalline polymers with at least one polymer melting point below 115° C., and a non-oxide electrically conductive ceramic powder. The non-oxide electrically conductive ceramic powder exhibits a certain particle size distribution. The PTC material layer has a resistivity below 0.1 Ω-cm. The initial resistance of the device is below 20 mΩ, and the area of the PTC material layer is below 30 $mm^2$. The over-current protection device exhibits a surface temperature below 100° C. under the trip state of over-current protection.

9 Claims, 2 Drawing Sheets

OVER-CURRENT PROTECTION DEVICE

BACKGROUND OF THE INVENTION

1. Field of the Invention

The present invention relates to an over-current protection device and, more particularly, to an over-current protection device comprising a positive temperature coefficient (PTC) conductive material. The over-current protection device presents better resistivity and resistance repeatability, especially suitable to the protection of a power source used in portable communication applications.

2. Description of the Prior Art

The resistance of PTC conductive material is sensitive to temperature change. With this property, the PTC conductive material can be used as current-sensing material and has been widely used in over-current protection devices and circuits. The resistance of the PTC conductive material remains at a low value at room temperature so that the over-current protection device or circuits can operate normally. However, if an over-current or an over-temperature situation occurs, the resistance of the PTC conductive material will immediately increase at least ten thousand times (over $10^4$ ohm) to a high-resistance state. Therefore, the over-current will be counterchecked and the objective of protecting the circuit elements or batteries is achieved.

In general, the PTC conductive material contains at least one crystalline polymer and conductive filler. The conductive filler is dispersed uniformly in the crystalline polymer(s). The crystalline polymer is mainly a polyolefin polymer such as polyethylene. The conductive filler(s) is mainly carbon black, metal particles and/or non-oxide ceramic powder, for example, titanium carbide or tungsten carbide.

The conductivity of the PTC conductive material depends on the content and type of the conductive fillers. Generally speaking, carbon black having a rough surface provides better adhesion with the polyolefin polymer, and accordingly, a better resistance repeatability is achieved. However, the conductivity of the carbon black is lower than that of the metal particles. If the metal particles are used as the conductive filler, their larger particle size results in less uniform dispersion, and they are prone to be oxidized, which causes high resistance. To effectively reduce the resistance of the over-current protection device and prevent oxidation, the ceramic powder tends to be used as the conductive filler in a low-resistance PTC conductive material. Since it lacks a rough surface like carbon black, the ceramic powder exhibits poor adhesion with the polyolefin polymer, and consequently, the resistance repeatability of the PTC conductive material is not well controlled. In prior arts, to improve the adhesion between the metal particles and the polyolefin polymer, a coupling agent will be added into the conventional PTC conductive material with the ceramic powder as the conductive filler. The coupling agent may be an anhydride compound or a silane compound. However, the total resistance of the PTC conductive material after the coupling agent is added cannot be reduced effectively.

Currently, a low-resistance (about 20 mΩ) PTC conductive material with nickel as the conductive filler is available in the public market, but it can only sustain a voltage up to 6V. If the nickel is not isolated well from the air, it is prone to be oxidized after a period, and this results in increasing resistance. In addition, the resistance repeatability of the low-resistance PTC conductive material is not satisfied after tripping.

SUMMARY OF THE INVENTION

The objective of the present invention is to provide an over-current protection device. By adding a conductive powder (conductive filler) with a certain particle size distribution and at least one crystalline polymer with a low melting point, the over-current protection device exhibits excellent resistance, fast tripping at a lower temperature, high voltage endurance and resistance repeatability.

In order to achieve the above objective, the present invention discloses an over-current protection device comprising two metal foils and a PTC material layer. Each of the two metal foils exhibits a rough surface with nodules and contacts the PTC material layer directly and physically. The PTC material layer is sandwiched between the two metal foils and comprises plural crystalline polymers and a non-oxide electrically conductive ceramic powder (i.e., a conductive filler). The PTC material could also contain some non-conductive fillers. The particle size distribution of the non-oxide electrically conductive ceramic powder is preferably between 0.01 μm and 30 μm, and more preferably between 0.1 μm and 10 μm. The non-oxide electrically conductive ceramic powder exhibits a resistivity below 500 μΩ-cm and is dispersed in the crystalline polymers. The crystalline polymers are selected from high-density polyethylene (HDPE), low-density polyethylene (LDPE), polypropylene and polyvinyl fluoride and a copolymer thereof. The PTC material layer comprises at least one crystalline polymer with a melting point below 115° C. to achieve the purpose of fast tripping at a low temperature.

To prevent the lithium batteries from overcharge, an over-current protection device applied therein is required to trip at a low temperature. Therefore, the PTC material layer used in the over-current protection device of the present invention could contain a crystalline polymer with a lower melting point (e.g., LDPE) or could contain at least one crystalline polymer, in which the at least one crystalline polymer comprises at least one polymer with a melting point below 115° C. The above LDPE can be polymerized using Ziegler-Natta catalyst, Metallocene catalyst or other catalysts, or can be copolymerized by vinyl monomer or other monomers such as butane, hexane, octene, acrylic acid, or vinyl acetate.

The non-oxide electrically conductive ceramic used in the present invention is selected from: (1) metal carbide (e.g., titanium carbide (TiC), tungsten carbide (WC), vanadium carbide (VC), zirconium carbide (ZrC), niobium carbide (NbC), tantalum carbide (TaC), molybdenum carbide (MoC) and hafnium carbide (HfC)); (2) metal boride (e.g., titanium boride ($TiB_2$), vanadium boride ($VB_2$), zirconium boride ($ZrB_2$), niobium boride ($NbB_2$), molybdenum boride ($MoB_2$) and hafnium boride ($Hfb_2$)) and (3) metal nitride (e.g., zirconium nitride (ZrN)).

The non-oxide electrically conductive ceramic powder used in the present invention could exhibit various shapes, e.g., spherical, cubical, flake, polygonal, cylindrical, and so on. In general, the hardness of the non-oxide electrically conductive ceramic powder is relatively high and the manufacturing method thereof is different from that of the carbon black or the metal powder. Consequently, the shape of the non-oxide electrically conductive ceramic powder is mainly a low structure (with the particle size below 10 μm and the aspect ratio below 10), which is different from that of the carbon black or the metal powder with high structure.

The non-conductive filler, which could be incorporated into the PTC material in the present invention, is selected from: (1) an inorganic compound with the effects of flame retardant and anti-arcing, e.g., zinc oxide, antimony oxide, aluminum oxide, aluminum nitride, boron nitride, fused silica, silicon oxide, calcium carbonate, magnesium sulfate and barium sulfate and (2) an inorganic compound with a hydroxyl group, e.g., magnesium hydroxide, aluminum hydroxide, calcium hydroxide, and barium hydroxide. The particle size of the non-conductive filler is mainly between 0.05 μm and 50 μm and the non-conductive filler is 1% to 20% by weight of the total composition of the PTC material layer.

The resistivity of the non-oxide electrically conductive ceramic powder is extremely low (below 500 μΩ-cm) and thus the PTC material layer containing the non-oxide electrically conductive ceramic powder can achieve a resistivity below 0.1 Ω-cm. In general, the lowest resistivity limit of the conventional carbon black containing PTC material is around 0.2 Ω-cm. It is extremely difficult to prepare PTC material to have a resistivity below 0.1 Ω-cm based on the conventional carbon black system. Even if the resistivity of the metal powder filled PTC material could falls below 0.1 Ω-cm, this type of PTC material usually fails to keep voltage endurance due to excessively loading of metal powder and the lack of dielectric property in the PTC material. However, the PTC material layer of the over-current protection device of the present invention can reach a resistivity below 0.1 Ω-cm and still can sustain a voltage from 12V to 40V and a current up to 50 A.

When the conventional PTC material reaches a resistivity below 0.1 Ω-cm, it usually cannot sustain voltage higher than 12V. In the present invention, a non-conductive filler, an inorganic compound with a hydroxyl group, is added into the PTC material layer to improve the voltage endurance. In addition, the thickness of the PTC material layer is controlled to be over 0.2 mm and thus the voltage endurance of the PTC material layer is enhanced substantially.

The addition of the inorganic compound into the PTC material layer can adjust the trip jump value (i.e., $R_1/R_i$ indicating the resistance repeatability) to be below 3, wherein $R_i$ is the initial resistance value and $R_1$ is the resistance measured one hour later after a trip back to room temperature.

Since the PTC material layer exhibits extremely low resistivity, the area of the PTC chip (i.e., the PTC material layer required in the over-current protection device of the present invention) cut from the PTC material layer can be shrunk below 50 $mm^2$, preferably below 30 $mm^2$, and the PTC chip will still present the property of low resistance. Accordingly, more PTC chips are produced from one PTC material layer, and thus the cost is reduced.

The over-current protection device further comprises two metal electrode sheets, connected to the two metal foils by solder reflow or by spot welding to form an assembly. The shape of the assembly (the over-current protection device) is axial-leaded, radial-leaded, terminal, or surface-mounted. Also, the two metal foils may connect to a power source to form a conductive circuit loop such that the over-current protection device protects the circuit during an over-current situation.

BRIEF DESCRIPTION OF THE DRAWINGS

The invention will be described according to the appended drawing in which.

DETAILED DESCRIPTION OF THE INVENTION

Figure 1:
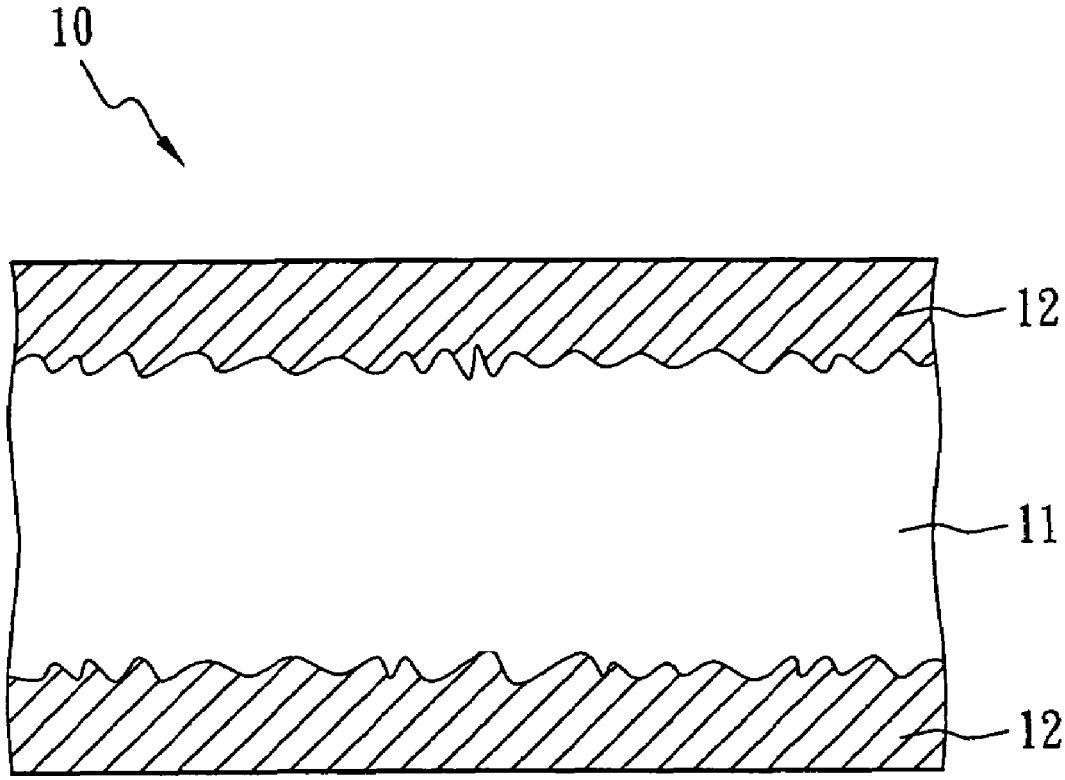
FIG. 1 illustrates the over-current protection device of the present invention.

The following will describe the compositions and the manufacturing process of two embodiments (i.e., Example I and Example II) of the over-current protection device of the present invention with accompanying figures.

The composition and weight (unit in grams) thereof of the PTC material layer in the over-current protection device of the present invention and a comparative example are shown in Table 1 below.

TABLE 1

| | LDPE-1 (g) | HDPE-1 (g) | HDPE-2 (g) | $Mg(OH)_2$ (g) | TiC (g) |
|---|---|---|---|---|---|
| Example I | 12.66 | 0.50 | — | 6.04 | 92.60 |
| Example II | 11.20 | — | — | 5.04 | 93.60 |
| Comparative Example | — | 3.16 | 12.65 | 4.20 | 90.90 |

In Table 1, LDPE-1 is a low-density crystalline polyethylene (density: 0.924 $g/cm^3$; melting point: 113° C.); HDPE-1 is a high-density polyethylene (density: 0.943 $g/cm^3$; melting point: 125° C.); HDPE-2 is a high-density polyethylene (density: 0.962 $g/cm^3$; melting point: 131° C.); $Mg(OH)_2$ is 96.9 wt % magnesium hydroxide mixed with 0.5% calcium oxide (CaO), 0.85% sulfamic acid ($SO_3$), 0.13% silicon dioxide ($SiO_2$), 0.03% iron oxide ($Fe_2O_3$), and 0.06% aluminum oxide ($Al_2O_3$). The average particle size of the titanium carbide (TiC) is 3 μm and the aspect ratio of the particle thereof is below 10.

The manufacturing process of the over-current protection device is described as follows. The raw material is fed into a blender (Hakke 600) at 160° C. for 2 minutes. The procedure of feeding the raw material is: add the crystalline polymers (i.e., LDPE-1 and HDPE-1 for Example I; LDPE-1 for Example II) into the blender; after blending for a few seconds, add the non-oxide electrically conductive ceramic powder (i.e., titanium carbide with particle size distribution between 0.1 μm and 10 μm). The rotational speed of the blender is set at 40 rpm. After blending for 3 minutes, the rotational speed is increased to 70 rpm. After blending for 7 minutes, the mixture in the blender is drained and thereby a conductive composition with positive temperature coefficient (PTC) behavior is formed.

The above conductive composition is loaded symmetrically into a mold with outer steel plates and a 0.35 mm-thick middle, wherein the top and the bottom of the mold are disposed with a Teflon cloth. First, the mold loaded with the conductive composition is pre-pressed for 3 minutes at 50 $kg/cm^2$, 180° C. Then the generated gas is exhausted and the mold is pressed for 3 minutes at 100 $kg/cm^2$, 180° C. After that, the press step is repeated once at 150 $kg/cm^2$, 180° C. for 3 minutes to form a PTC material layer 11 (refer to FIG. 1). The thickness of the PTC material layer 11 in Example I and Example II is 0.35 mm or 0.45 mm.

Figure 2:
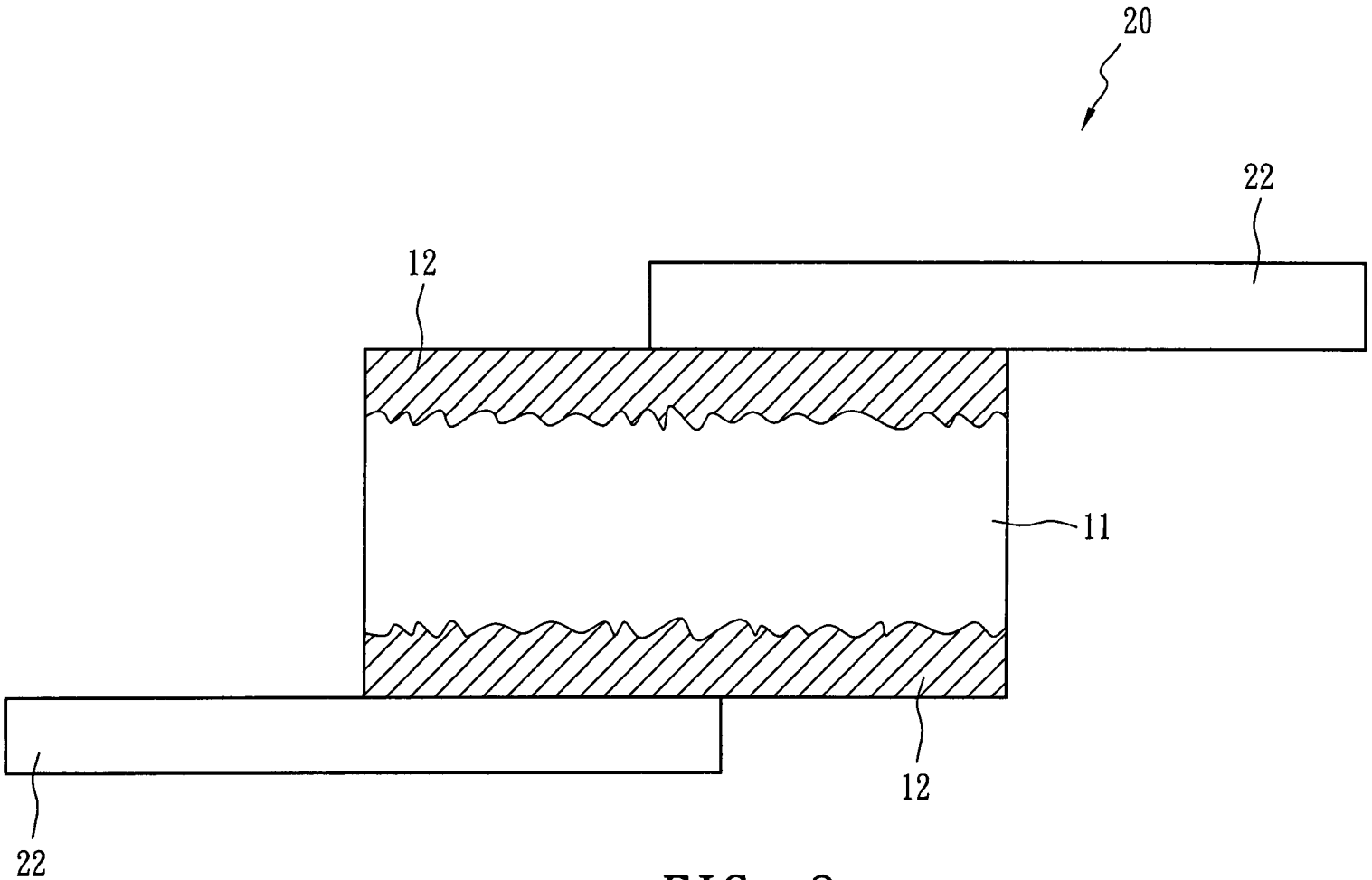
FIG. 2 illustrates another embodiment of the over-current protection device of the present invention.

The above PTC material layer 11 is cut into many squares, each with an area of 20×20 cm. Then, two metal foils 12 physically contact the top surface and the bottom surface of the PTC material layer 11, in which the two metal foils 20 are symmetrically placed upon the top surface and the bottom surface of the PTC material layer 11. Each metal foil 12 uses a rough surface with plural nodules (not shown) to physically contact the PTC material layer 11. Next, two Teflon cloths (not shown) are placed upon the two metal foils 12. Then, two steel plates (not shown) are placed upon the two Teflon cloths. As a result, all of the metal foils, Teflon cloths and the steel plates are disposed symmetrically on the top and the bottom surfaces of the PTC material layer 11 and a multi-layered structure is formed. The multi-layered structure is then pressed for 3 minutes at 70 kg/cm$^2$, 180° C. Next, the multi-layered structure is cut to form the over-current protection device 10 of 3.5×6.5 mm$^2$, or of 3.4×4.1 mm$^2$. After that, two metal electrode sheets 22 are connected to the metal foils 12 by solder reflow to form an axial-leaded over-current protection device 20 (refer to FIG. 2).

The resistivity (ρ) of the PTC material layer 11 is calculated by formula (1) below.

$$\rho = \frac{R \cdot A}{L} \tag{1}$$

wherein R, A, and L indicate the resistance (Ω), the area (cm$^2$), and the thickness (cm) of the PTC material layer 11, respectively. Substituting the initial resistance of 0.0069Ω (refer to Table 2 below), the area of 3.5×6.5 mm$^2$, and the thickness of 0.45 mm for R, A, and L in formula (1), respectively, results in a resistivity (ρ) of 0.0349 Ω-cm, which is obviously below 0.1 Ω-cm.

In addition, the axial-leaded over-current protection device 20 undergoes a trip test in the conditions of 6V/0.8 A at 80° C. to simulate a situation in which the temperature of the battery equipped with the axial-leaded over-current protection device 20 increases to 80° C. in the over-charge condition of 6V/0.8 A and the axial-leaded over-current protection device 20 has to trip and cut off the current to protect the battery.

Table 2 shows that Example I and Example II can trip in the trip test; however, the Comparative Example cannot trip to protect the battery. Additionally, the surface temperatures of the axial-leaded over-current protection device 20 under 6V, 12V, and 16V (i.e., under the trip state of over-current protection) are below 100° C., which are shown in Table 2. However, the Comparative Example exhibits a surface temperature above 100° C., at least 10° C. higher than those of Examples I and II. Therefore, the over-current protection devices in the two embodiments (i.e., Examples I and II), utilizing the non-oxide electrically conductive ceramic power with the initial resistance below 0.01Ω, can trip at a lower temperature and are more sensitive to temperature than the Comparative Example.

TABLE 2

| | Chip Size (mm × mm) | Thickness (mm) | $R_i$ (mΩ) | ρ (Ω-cm) | Trip Test 6 V 80° C./0.8 A | Surface Temperature @ Trip State 6 V/6 A | 12 V/6 A | 16 V/6 A |
|---|---|---|---|---|---|---|---|---|
| Example I | 3.4 × 4.1 | 0.35 | 8.2 | 0.0381 | Trip | 89° C. | 91° C. | 92° C. |
| Example II | 3.5 × 6.5 | 0.45 | 6.9 | 0.0349 | Trip | 87° C. | 89° C. | 91° C. |
| Comparative Example | 3.5 × 6.5 | 0.45 | 7.3 | 0.0369 | No trip | 104° C. | 105° C. | 107° C. |

From Table 2, the over-current protection device of the present invention, by adding a conductive filler with a certain particle distribution and at least one crystalline polymer with a low melting point (below 115° C.), meets the expected objective of excellent resistance (the initial resistance below 20 mΩ), fast tripping at a lower temperature (e.g., 80° C.), high voltage endurance and resistance repeatability.

The devices and features of this invention have been sufficiently described in the above examples and descriptions. It should be understood that any modifications or changes without departing from the spirit of the invention are intended to be covered in the protection scope of the invention.

What is claimed is:

1. An over-current protection device, comprising:

two metal foils; and a positive temperature coefficient (PTC) material layer sandwiched between the two metal foils, exhibiting a resistivity below 0.1 Ω-cm, and comprising:

a plurality of crystalline polymers, wherein at least one of the crystalline polymer exhibits a melting point below 115° C.; and a non-oxide electrically conductive ceramic powder consisting essentially of the particle size from 0.1 μm to 10 μm and having a resistivity below 500 μΩ-cm, and dispersed in the crystalline polymers;

wherein the initial resistance of the over-current protection device is below 20 mΩ, the area of the PTC material layer is below 30 mm$^2$, and the over-current protection device exhibits a surface temperature below 100° C. under the trip state of over-current protection.

2. The over-current protection device of claim 1, wherein the thickness of the PTC material layer is larger than 0.2 mm.

3. The over-current protection device of claim 1, which exhibits a resistance repeatability ratio below 3.

4. The over-current protection device of claim 1, wherein the non-oxide electrically conductive ceramic powder is titanium carbide.

5. The over-current protection device of claim 1, wherein the at least one crystalline polymer with the melting point below 115° C. comprises a low-density polyethylene.

6. The over-current protection device of claim 1, further comprising a non-conductive inorganic filler.

7. The over-current protection device of claim 6, wherein the non-conductive inorganic filler is magnesium hydroxide.

8. The over-current protection device of claim 1, further comprising two metal electrode sheets connected to the two metal foils so as to form an assembly.

9. The over-current protection device of claim 1, wherein the two metal foils are connected to a power source to form a conductive circuit loop.

* * * * *